US007331319B1

(12) United States Patent
Rumley

(10) Patent No.: US 7,331,319 B1
(45) Date of Patent: Feb. 19, 2008

(54) CAM HUB MOUNTING ASSEMBLY

(75) Inventor: Kevin L. Rumley, Greensboro, NC (US)

(73) Assignee: CV Products, Inc., Thomasville, NC (US)

( * ) Notice: Subject to any disclaimer, the term of this patent is extended or adjusted under 35 U.S.C. 154(b) by 426 days.

(21) Appl. No.: 11/083,479

(22) Filed: Mar. 18, 2005

(51) Int. Cl.
*F01L 1/02* (2006.01)

(52) U.S. Cl. ..... 123/90.31; 123/90.27; 123/90.6

(58) Field of Classification Search ..... 123/90.15, 123/90.16, 90.17, 90.18, 90.31, 90.27, 90.34, 123/90.6; 29/888.1
See application file for complete search history.

(56) References Cited

U.S. PATENT DOCUMENTS 2,980,989 A * 4/1961 Malcolm ..... 29/888.01
5,152,263 A * 10/1992 Danieli ..... 123/90.17
6,202,611 B1 * 3/2001 Regueiro ..... 123/90.17
6,591,713 B2 * 7/2003 Jesel ..... 74/567

* cited by examiner

*Primary Examiner*—Ching Chang

(57) ABSTRACT

A cam hub mounting assembly for a camshaft having a cam cover rotationally mounted within a cam cover retainer with a bearing retainer ring therebetween having a plurality of slots, each slot rotationally maintaining a ball bearing positioned in a smooth U-shaped groove on the outside of the cam cover and in a smooth U-shaped groove on the inside of the cam cover retainer. The method of assembly allows the inner and outer grooves to collectively act as inner and outer bearing races for the ball bearings. The axial position of the cam cover is maintained within the bearing retainer and does not require endplay spacing when the cam cover is attached to the camshaft. The cam cover can have one or more balancing bores therein for rotationally balancing. The cam hub mounting assembly permits a camshaft to be attached thereto and to rotate at speeds exceeding approximately sixteen thousand revolutions per minute (16,000 rpm) for use in racing engines.

7 Claims, 9 Drawing Sheets

CAM HUB MOUNTING ASSEMBLY

FIELD OF THE INVENTION

The invention herein pertains to a cam hub mounting assembly for rotationally attaching a camshaft for an internal combustion engine.

DESCRIPTION OF THE PRIOR ART AND OBJECTIVES OF THE INVENTION

Typically, an engine mechanically rotates a camshaft for operable combustion. The camshaft regulates the timing for delivering an air/fuel mixture into the cylinders of an engine for compression and combustion therein and removing the resulting exhaust therefrom by cycling the intake and exhaust valves between open and closed positions. Each valve is positioned either directly or through linkage on a lobe (cam) of the camshaft. Each lobe extends radially from the camshaft and the particular shape of the lobe determines the timing of the valve cycle. As the lobe rotates with the camshaft, the radial edge of the lobe slides on the valve pressing the valve open during one phase of the cycle while allowing a valve spring to urge the valve closed during another phase. As the position (shape) of a conventional lobe typically changes not only in the radial direction but also along the axial direction of the camshaft, valve contact positioning on the lobe is critical to maintain the desired timing of valve cycle for each cylinder.

Generally, the rotation of the engine crankshaft is directed to drive the camshaft by gears linked by a timing belt or chain whereby the camshaft is connected to a cam gear which rotates once for every two (2) crankshaft rotations. When using a tooth belt to drive the camshaft, an additional engine block plate must be installed behind the cam and crank gears/pulleys to seal the engine oil whereby the engine block plate is affixed to the engine block while the camshaft is linked to the crankshaft through an opening in the engine block plate. Usually, the camshaft is positioned inside the engine where it is lubricated in oil and is affixed to a conventional cam hub which mounts the camshaft in an opening in the engine block sealing the oil therein and attaches to the cam gear on the outside of the engine. Conventional cam hubs typically have a cylindrically shaped cam cover having an outer flange extending radially therefrom and a uniformly ring shaped cam cover retainer bolted to the engine block, securing the cam cover outer flange therebetween and around the opening in the engine block whereby the conventional cam cover outer flange has a diameter larger than the opening in the engine block/engine block plate. Following assembly, as the conventional cam cover is rotated, the rear side of its outer flange slides directly against the face of the engine block (engine block plate) tracking around the opening therein while the front side of its outer flange slides against the conventional cam cover retainer. A conventional needle bearing assembly may be positioned on one or both sides of the cam cover flange to reduce sliding friction. In addition, conventional thrust washers may be placed against the engine block and the cam cover retainer to adjust camshaft endplay and provide a replaceable wear surface whereby the conventional cam cover outer flange or needle bearing assembly will rotate thereon. Further, shims may need to be added for proper positioning of the camshaft within the engine block opening including providing the desired angle and range of camshaft endplay.

There are many disadvantages to conventional designs for rotationally affixing the camshaft to the engine block/plate. First, the rotation of the cam cover outer flange sliding against a flat surface creates friction and heat causing wear, contamination, and limits the maximum rotational speed of the camshaft before failure. The addition of one or more conventional needle bearing assemblies reduces the surface area in sliding contact resulting in reduced friction, heat and wear. However, conventional needle bearing assemblies typically fail when used with engines turning in excess of about ten thousand revolutions per minute (10,000 rpm).

Second, conventionally designed cam hubs generally require space for the cam cover outer flange to move back and forth between the cam cover retainer and the engine block to allow space for lubricants, expansion from heat and easier starts. The space or camshaft endplay allows the camshaft to move longitudinally which can impact the positioning of the valves on the lobes and disrupt desired timing cycles. Additionally, the camshaft endplay may increase as a result of wear and breakdown augmenting the range of the linear movement of the camshaft and the severity of the possible disruption in valve cycle timing.

Third, conventional camshafts usually have a locating dowel (pin) which represents the cycle position of the camshaft and extends through the cam cover providing the camshaft rotational position on the outside of the engine which otherwise could not be seen. Since the camshaft locating pin receptacle of a conventional cam cover is typically positioned between two (2) of the three (3) mounting channels that encircle a central mounting channel, the conventional cam cover is in a state of rotational imbalance which is translated to the camshaft during rotation thereof. As the rotational speed of the camshaft increases, the imbalance of the cam cover is magnified and can lead to uneven wear, improper timing and premature failure of the cam hub and front cam bearing.

Thus, in view of the problems and disadvantages of conventionally mounted camshafts in the engine block, the present invention was conceived and one of its objectives is to provide a cam hub mounting assembly which will allow the camshaft to rotate completely within the engine block rather than slide against it.

It is a further objective of the present invention to provide a cam hub mounting assembly for rotationally mounting a camshaft through an engine block with substantially no camshaft endplay thus eliminating movement of the camshaft in a direction along its axis.

It is still another objective of the present invention to provide a cam hub mounting assembly which will allow the camshaft to operate at high engine speeds greater than ten thousand revolutions per minute (10,000 rpm) such as presently achieved in high performance and racing engines while maintaining structural integrity.

It is still a further objective of the present invention to provide a cam hub mounting assembly with a rotationally balanced cam cover.

It is yet another objective of the present invention to provide a cam cover retainer shaped to mount to an engine block (engine block plate) extending through the opening therein while surrounding a cam cover rotatable against the inside circumference of the cam cover retainer through bearings.

Various other objectives and advantages of the present invention will become apparent to those skilled in the art as a more detailed description is set forth below.

SUMMARY OF THE INVENTION

The aforesaid and other objectives are realized by providing an improved cam hub mounting assembly utilizing an improved cam cover rotationally mounted within an improved cam cover retainer that is affixed about the opening of an engine block. The cam cover and the cam cover retainer respectively define a circumferential groove and an inner groove which are concentrically aligned when assembled. Bearings are positioned between the cam cover and the cam cover retainer in the circumferential and inner grooves which operate as inner and outer bearing races respectively. The cam cover has one or more balancing bores for providing rotational balance thereto within the cam cover retainer. The cam hub mounting assembly permits rotation of a camshaft attached to the cam cover while preventing longitudinal movement thereof. The cam hub mounting assembly allows a camshaft attached thereto to achieve high rotational speeds in excess of, for example sixteen thousand revolutions per minute (16,000 rpm) as may be desirable for high performance engines.

DETAILED DESCRIPTION OF THE PREFERRED EMBODIMENT AND OPERATION OF THE INVENTION

Figure 1:
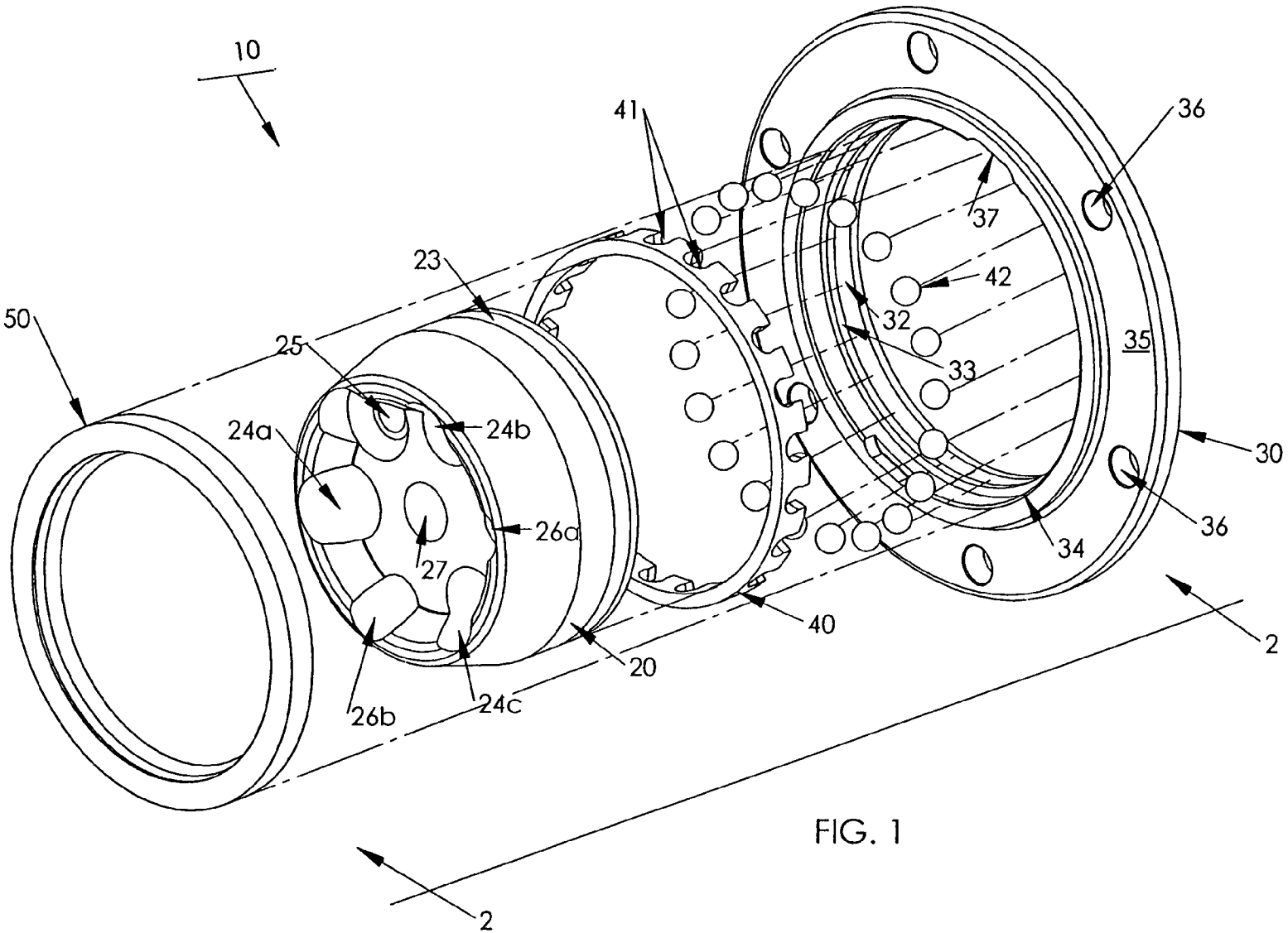
FIG. 1 shows an exploded front perspective view of the preferred cam hub mounting assembly of the invention.
Figure 2:
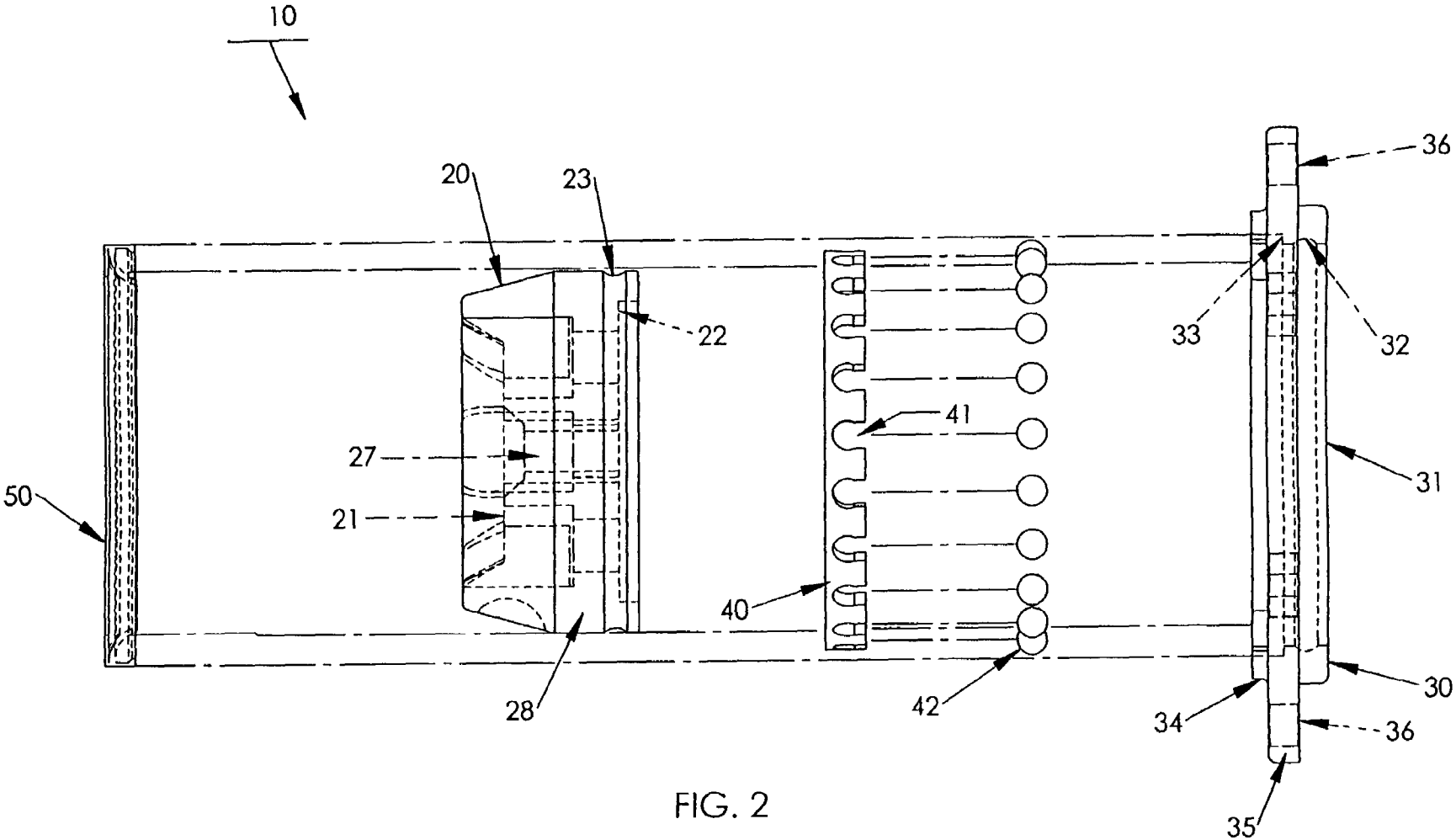
FIG. 2 demonstrates an exploded side elevational view of the preferred cam hub mounting assembly as seen in FIG. 1.
Figure 6:
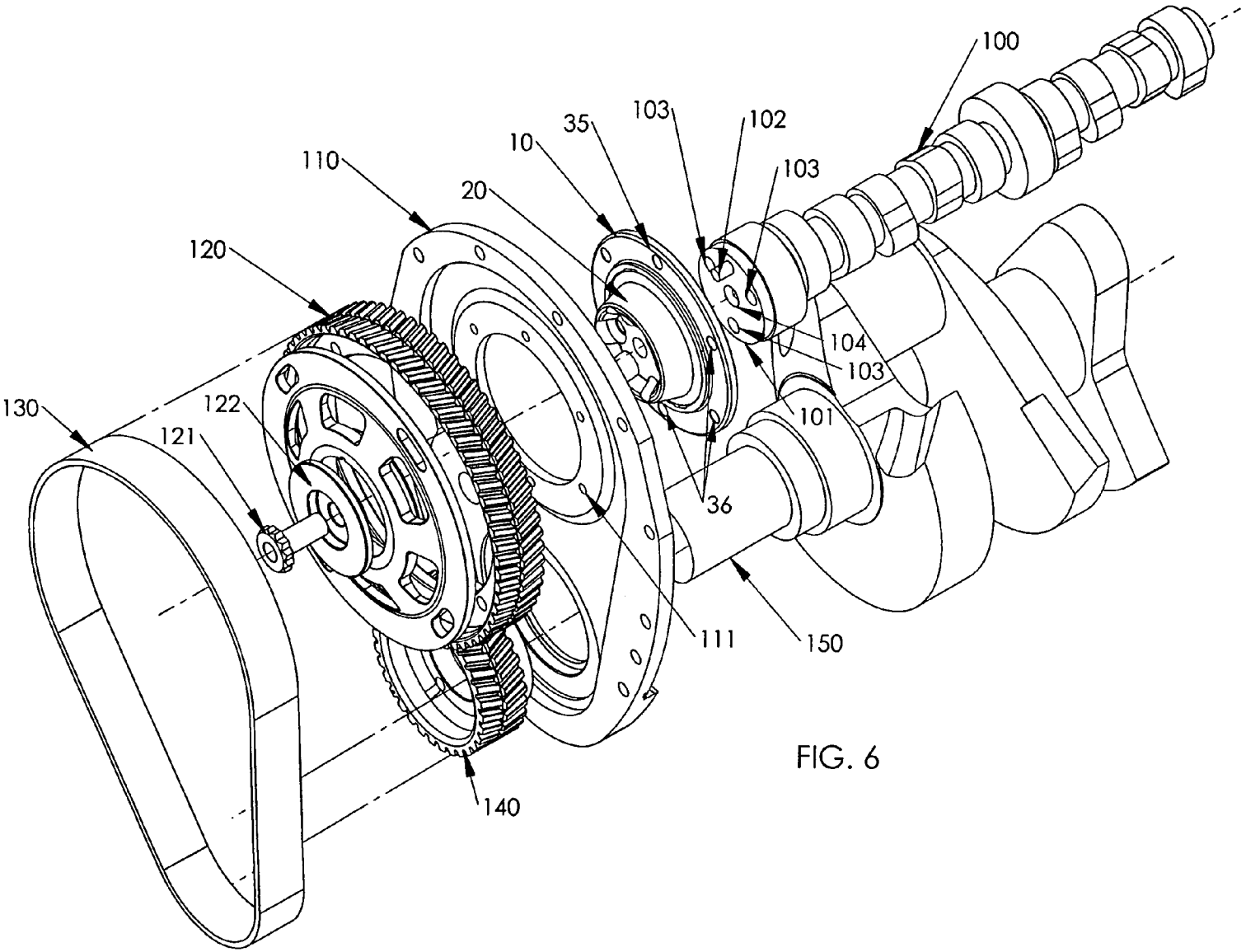
FIG. 6 illustrates an exploded partial top perspective view of the preferred cam hub mounting assembly as shown in FIG. 1 as in a typical engine.

For a better understanding of the invention and its operation, turning now to the drawings, FIG. 1 shows exploded preferred cam hub mounting assembly 10 comprising cam cover 20 rotationally mounted within cam cover retainer 30 with bearing retainer 40 positioned therebetween and cam hub sealing washer 50 which assists in preventing oil from leaking out. Cam hub mounting assembly 10 may be used to mount camshaft 100 through engine block plate 110 as seen in FIG. 6. As seen in FIG. 2, cam cover 20 comprises cylindrically shaped body 28 having front face 21 and rear face 22 which are opposingly positioned and inset from the ends of cam cover 20. Rear face 22 receives end 101 of conventional camshaft 100 (FIG. 6) flush thereagainst while front face 21 receives conventional cam gear 120 (FIG. 6). As shown in FIG. 2, cam cover 20 further defines circumferential groove 23 which encircles cam cover 20 and is contiguous to rear face 22. Circumferential groove 23 has a uniform arcuately contoured U-shaped cross-section and operates as an inner bearing race for receiving a plurality of ball bearings 42 therein (FIGS. 1 and 2).

Figure 4:
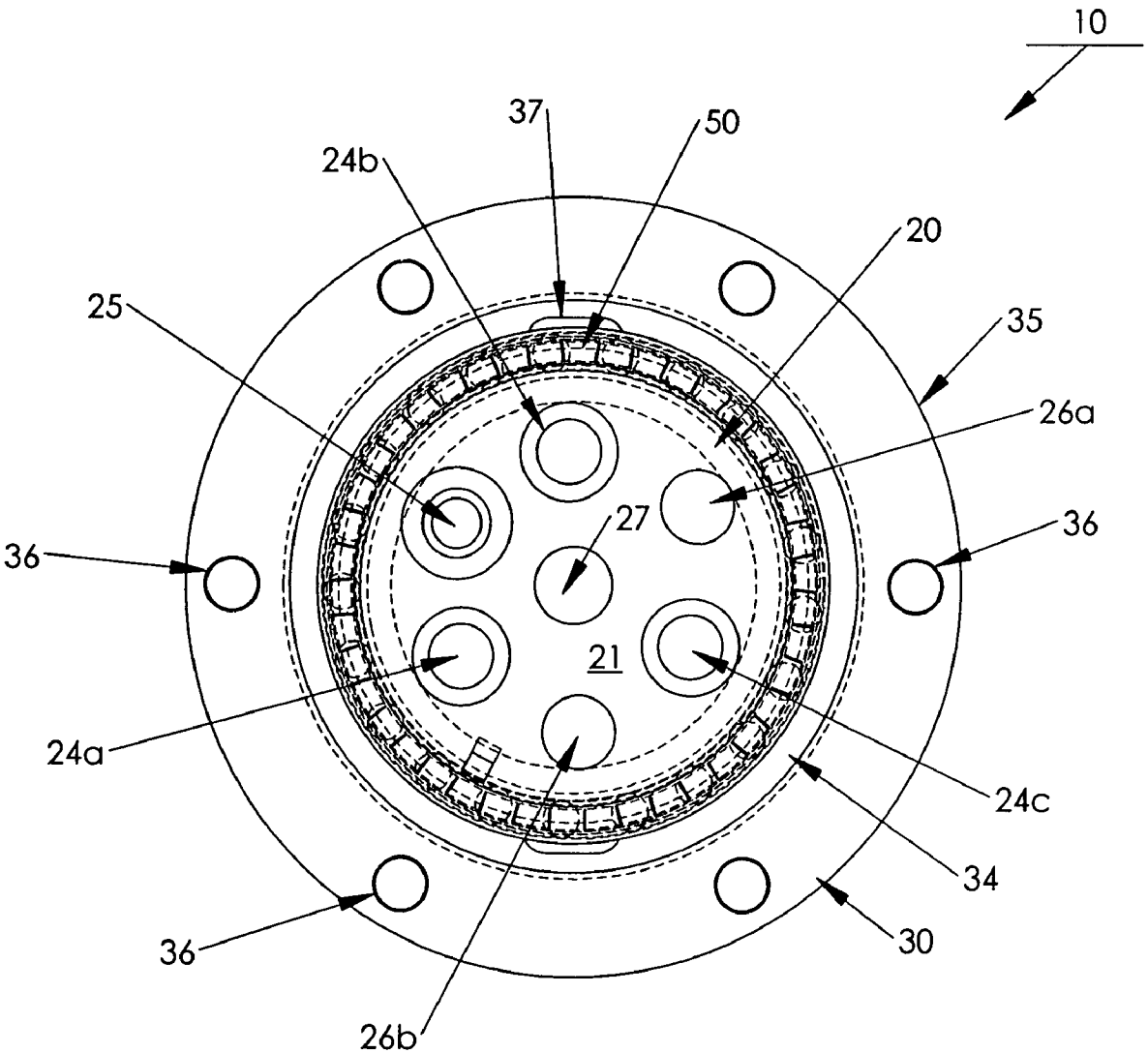
FIG. 4 shows a front view of the preferred cam hub mounting assembly as shown in FIG. 3.
Figure 5:
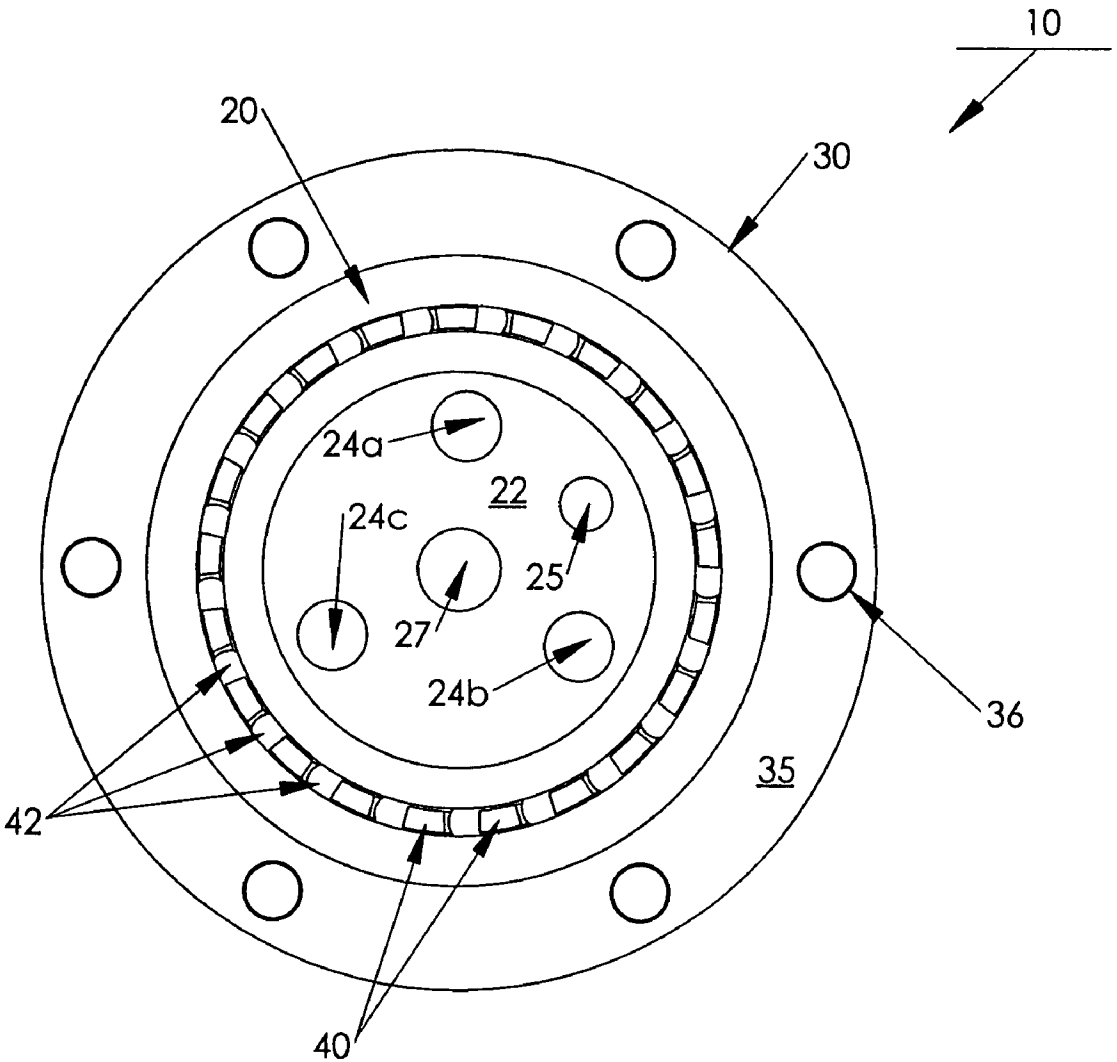
FIG. 5 depicts a rear view of the preferred cam hub mounting assembly as shown in FIG. 4.

As demonstrated in FIG. 4, cam cover 20 further defines three (3) conventional camshaft mounting channels 24*a*, 24*b*, 24*c* therethrough about conventional left-threaded axial cam gear mounting channel 27. Camshaft mounting channels 24*a*, 24*b*, 24*c* are equally spaced from cam gear mounting channel 27 and from each other at one hundred twenty degree (120°) increments. When cam hub mounting assembly 10 is mounted to camshaft 100 as shown in FIG. 6 and positioned in an engine (not shown), camshaft mounting channels 24*a*, 24*b*, 24*c* each receive a conventional camshaft bolt (not shown) that extends through cam cover 20 and is threadably received in threaded channels 103 of camshaft 100 for mounting the same to cam cover 20 while cam gear mounting channel 27 receives conventional cam gear bolt 121 through cam gear washer 122. As further seen in FIG. 4, cam cover 20 also defines camshaft locating pin receptacle 25 which is positioned between camshaft mounting channels 24*a* and 24*b* for receiving conventional camshaft locating pin 102 of camshaft 100 seen in FIG. 6. Camshaft mounting channels 24*a*, 24*b*, 24*c*, camshaft locating pin receptacle 25 and cam gear mounting channel 27 are positioned axially parallel to cam cover 20 while extending through front face 21 and rear face 22. As also shown in FIGS. 1 and 4, front face 21 preferably defines a pair of balancing bores 26*a*, 26*b* positioned respectively between camshaft mounting channels 24*b*, 24*c* and 24*c*, 24*a*. Balancing bores 26*a*, 26*b* are for rotationally balancing cam cover 20 which may be out of balance due to the conventional positioning of camshaft locating pin receptacle 25. Although balancing bores 26*a*, 26*b* as presented do not extend through rear face 22 as shown in FIG. 5, they could be sized whereby balancing of cam cover 20 would necessitate such extension of one or both.

Figure 3:
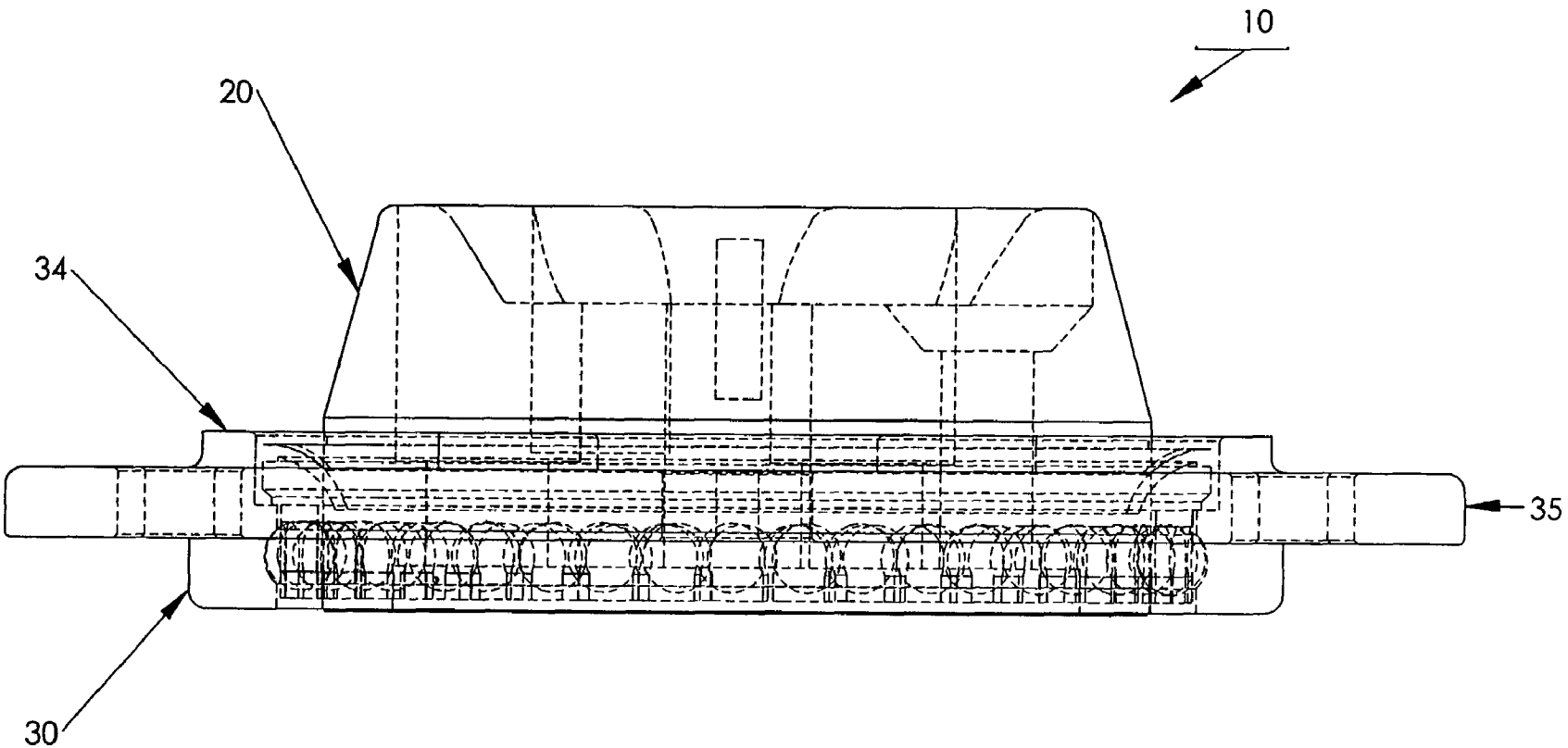
FIG. 3 illustrates an assembled view of the preferred cam hub mounting assembly as seen in FIG. 2.

Cam cover retainer 30 as shown in FIG. 1 is cylindrically shaped with central opening 31 extending therethrough for containing cam cover 20 as seen in FIG. 3. As further seen in FIG. 1, cam cover retainer 30 defines inner groove 32 which encircles central opening 31. Inner groove 32 has a uniform arcuately contoured U-shaped cross-section similar to that of circumferential groove 23 of cam cover 20 and operates as an outer bearing race for receiving ball bearings 42 therein as shown in FIG. 2. Although not shown, circumferential groove 23 and inner groove 32 may be shaped with linear surfaces to accommodate other bearings, such as roller bearings (not shown) therein. Inner groove 32 surrounds and is concentrically aligned with circumferential groove 23 when cam hub mounting assembly 10 is assembled whereby grooves 23, 32 are sized and shaped with tight tolerances to retain ball bearings 42 therewithin substantially preventing linear movement of cam cover 20 with respect to cam cover retainer 30.

As shown in FIGS. 1 and 2 cam cover retainer 30 further defines inner flange 33 contiguous inner groove 32 and washer mounting ring 34. Washer mounting ring 34 extends axially from inner flange 33 to the front of cam cover retainer 30 about central opening 31 and defines a pair of opposing D-shaped channels 37 which are in communication with the front of washer mounting ring 34 projecting radially therein from central opening 31. Upon assembly, inner flange 33 receives cam hub sealing washer 50 which engages washer mounting ring 34 while surrounding and engaging rotatable cam cover 20 to prevent oil passage from inside the engine block (not shown) through cam hub mounting assembly 10 as further seen in FIGS. 2 and 3. Channels 37 facilitate the engagement and removal of sealing washer 50 contained in washer mounting ring 34. Outer flange 35 extends radially from central opening 31 about the exterior of cam cover retainer 30 and defines a plurality of equally spaced engine block mounting channels 36 as seen in FIGS. 1, 4, 5 and 6 for receiving conventional engine block bolts (not shown) which threadably engage channels 111 (partially shown in FIG. 6) in engine block plate 110 and affix cam cover retainer 30 thereto. Each engine block mounting channel 36 is axially aligned with central opening 31. As shown in FIG. 6, outer flange 35 of cam cover retainer 30 engages engine block plate 110 while conventional tooth belt 130 engages conventional cam gear 120 and conventional crankshaft gear 140 for driving camshaft 100 whereby cam gear 120 is affixed to cam cover 20 and crankshaft gear 140 is affixed to crankshaft 150.

Bearing retainer ring 40 is cylindrically shaped as shown in FIG. 1 with a plurality of open ended U-shaped slots 41 extending therein and open to the rear thereof. Each slot 41 is shaped to rotationally maintain one (1) ball bearing 42 therein. Although ball bearings 42 are preferred, roller bearings (not shown) are also contemplated whereby the alternate bearing retainer ring (not shown) having alternate slots (not shown) would be shaped accordingly for rotationally maintaining the same.

During the method assembly of cam hub mounting assembly 10, bearing retainer ring 40 is placed around cam cover 20 within central opening 31 of cam cover retainer 30 while spaced from cam cover 20 and cam cover retainer 30. Ball bearings 42 are positioned in slots 41 and received in circumferential groove 23 of cam cover 20 and inner groove 32 of cam cover retainer 30. Each ball bearing 42 can track in reciprocal directions along grooves 23, 32 respectively allowing cam cover 20 to rotate about the coincidental axis of grooves 23, 32 while preventing linear movement therealong. Ball bearings 42 may be formed from ferrous or non-ferrous materials, but a standard ceramic composition is preferred for low wear and high thermal resistance to maintain camshaft rotational speeds, for example in excess of sixteen thousand revolutions per minute (16,000 rpm).

Figure 7:
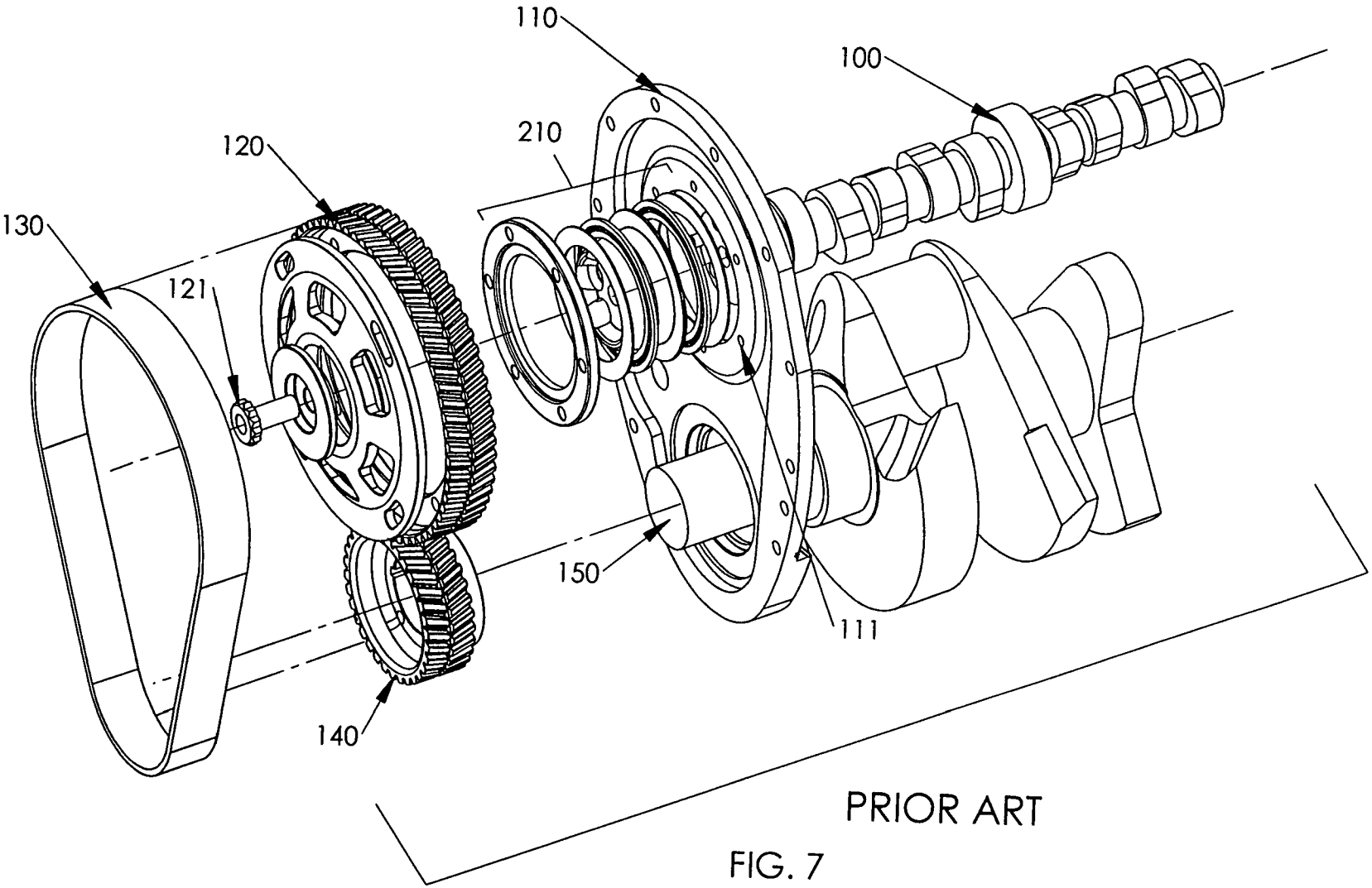
PRIOR ART FIG. 7
FIG. 7 shows an exploded partial top perspective view of a conventional cam hub assembly as may be positioned in a typical engine.
Figure 8:
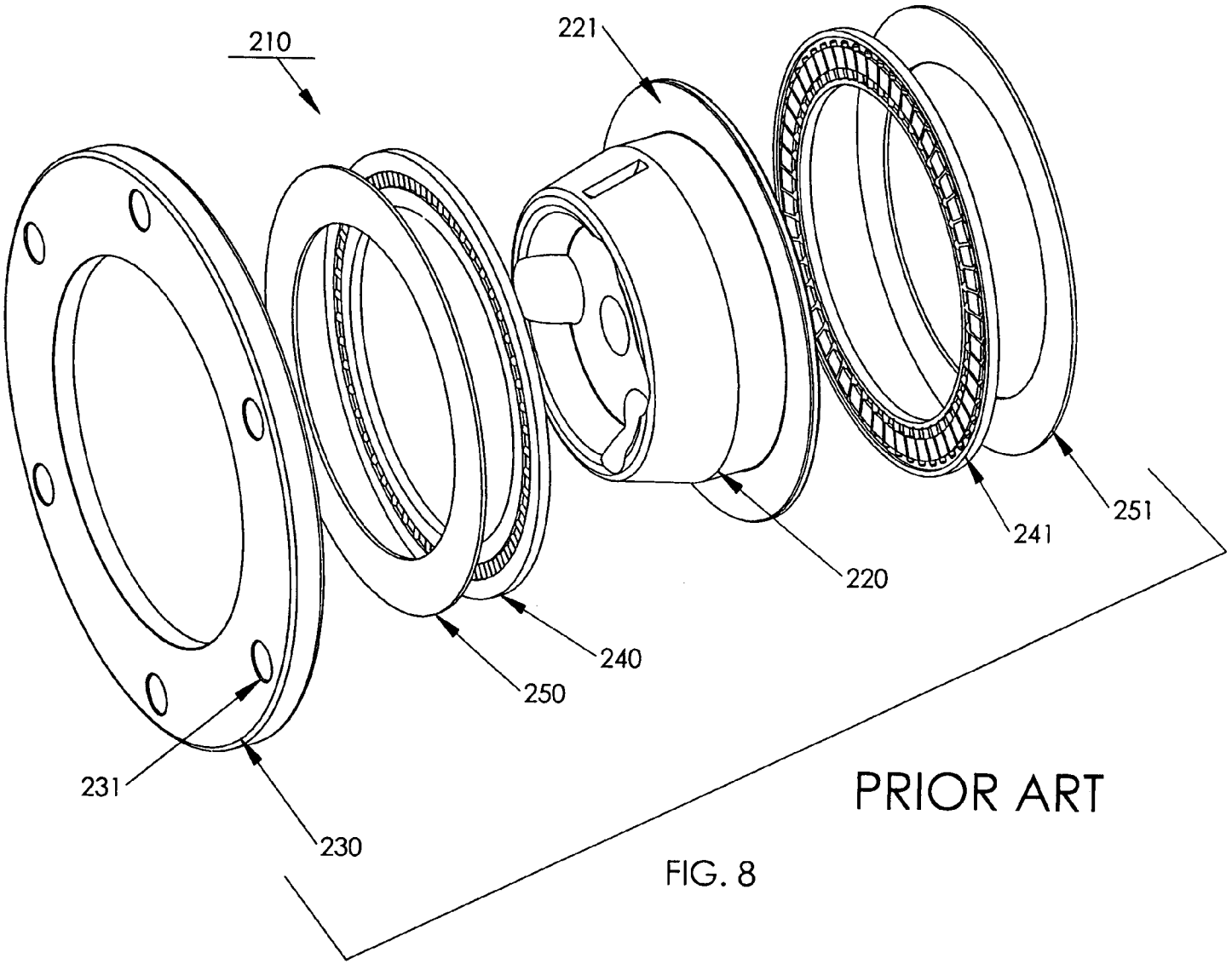
PRIOR ART FIG. 8
FIG. 8 demonstrates a front perspective view of a conventional cam hub assembly of FIG. 7.
Figure 9:
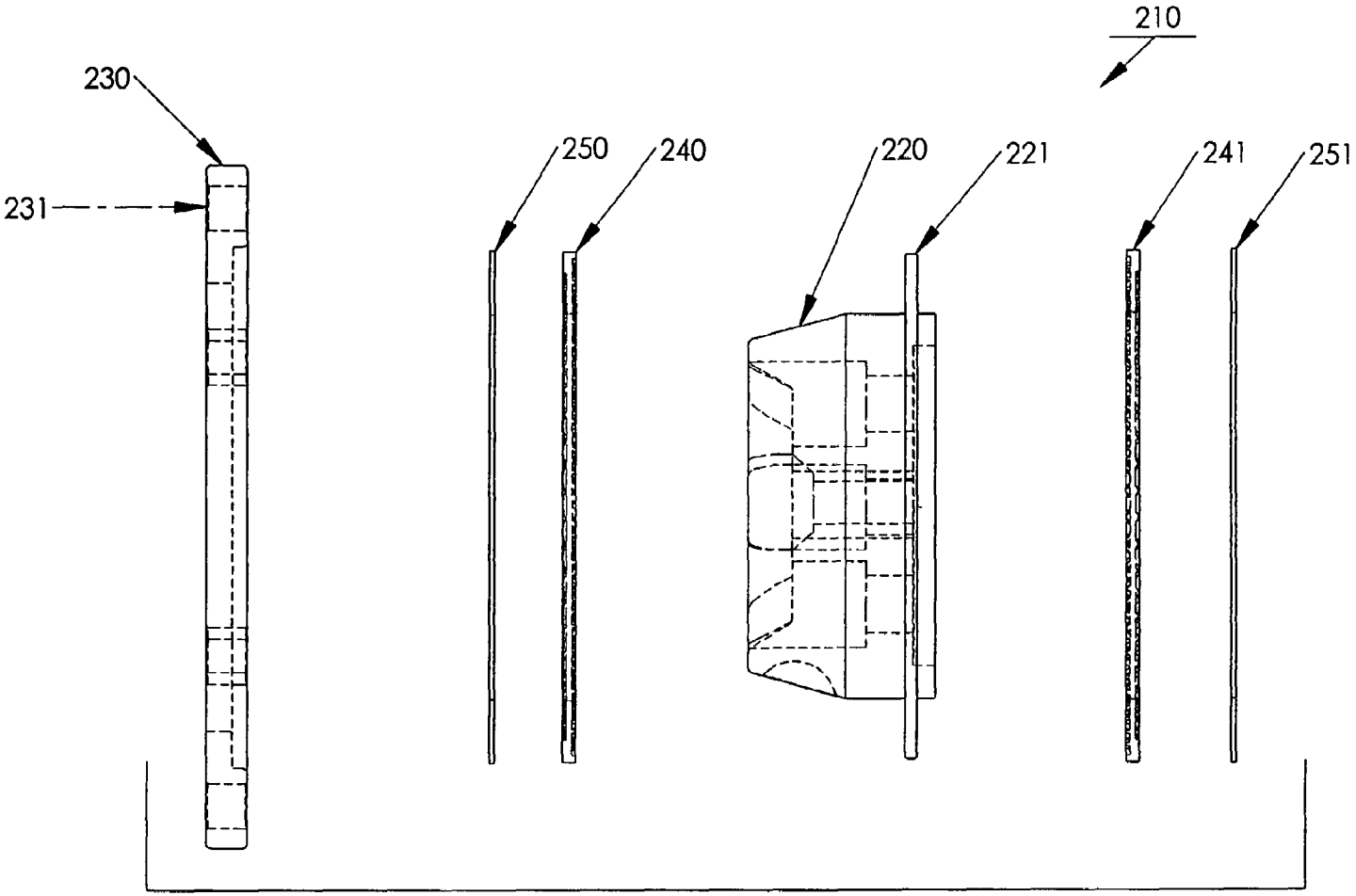
PRIOR ART FIG. 9
FIG. 9 shows an exploded side elevational view of a conventional cam hub assembly of FIG. 8.

FIGS. 7, 8 and 9 show conventional cam hub assembly 210 found in the prior art. FIG. 7 schematically shows cam hub assembly 210 in exploded fashion engaging engine block plate 110 while conventional tooth belt 130 engages conventional cam gear 120 and conventional crankshaft gear 140 for driving camshaft 100 whereby cam gear 120 is affixed to cam cover 220 (FIG. 8) and crankshaft gear 140 is affixed to crankshaft 150. As shown in FIGS. 8 and 9 conventional cam hub assembly 210 includes cam cover retainer 230 having a uniform ring shape with engine block mounting channels 231 extending therethrough and surrounding conventional cam cover 220 and its outer flange 221 which extends radially therefrom and is positioned between front and rear needle bearing assemblies 240 and 241 and front and rear thrust washers 250 and 251.

The illustrations and examples provided herein are for explanatory purposes and are not intended to limit the scope of the appended claims.

I claim:

1. A cam hub mounting assembly for a camshaft comprising: a cam cover, said cam cover comprising a body, said body defining a circumferential groove, a cam cover retainer, said cam cover retainer for mounting on an engine block, said cam cover rotatably mounted within said cam cover retainer, said cam cover retainer defining inner groove, said inner groove concentrically aligned about said circumferential groove, said inner groove and said circumferential groove respectively operating as outer and inner bearing races, a first bearing, said first bearing rotationally positioned within said inner and outer races between said cam cover and said cam cover retainer, and a bearing retainer ring, said bearing retainer ring positioned between said inner groove and said circumferential groove.

2. The cam hub mounting assembly of claim 1 wherein said bearing retainer ring defines a first open ended slot, said first bearing rotationally maintained within said first open ended slot.

3. The cam hub assembly of claim 2 further comprises a second bearing, said bearing retainer ring further defining a second open ended slot, each of said slots spaced from one another along said bearing retainer ring, each of said bearings rotationally maintained in different ones of said slots.

4. The cam hub mounting assembly of claim 1 wherein said first bearing comprises a ceramic composition.

5. The cam hub mounting assembly of claim 1 wherein said first bearing comprises a ball bearing.

6. A cam hub mounting assembly to control camshaft endplay comprising: a cam cover, said cam cover comprising a body, said body defining a circumferential groove, a cam cover retainer, said cam cover retainer receiving said cam cover, said cam cover retainer defining an inner groove, said inner groove aligned with said body circumferential groove to maintain a bearing therebetween, a bearing, a bearing retainer ring, said bearing retainer ring defining an open ended slot, said open ended slot receiving said bearing, whereby said cam cover retainer is mounted on an engine block with a camshaft attached to said cam cover to control the longitudinal movement of the camshaft.

7. The cam hub mounting assembly of claim 6 further comprising a sealing washer, said sealing washer positioned within said cam cover retainer.

* * * * *